United States Patent [19]

Marker

[11] Patent Number: 4,498,411

[45] Date of Patent: Feb. 12, 1985

[54] SAILBOARD RIG AND BOOM

[75] Inventor: Frank P. Marker, Garmisch-Partenkirchen, Fed. Rep. of Germany

[73] Assignee: Hannes Marker, Garmisch-Partenkirchen, Fed. Rep. of Germany

[21] Appl. No.: 372,565

[22] Filed: Apr. 28, 1982

[30] Foreign Application Priority Data

Apr. 30, 1981 [DE] Fed. Rep. of Germany ..... 3117312

[51] Int. Cl.[3] ..... B63H 9/10

[52] U.S. Cl. ..... 114/97; 114/90; 114/39

[58] Field of Search ..... 114/39, 97, 98, 90, 114/91; 267/155

[56] References Cited

U.S. PATENT DOCUMENTS 4,027,899 6/1977 Hawes et al. ..... 267/155

FOREIGN PATENT DOCUMENTS 2912868 10/1980 Fed. Rep. of Germany ..... 114/98

OTHER PUBLICATIONS

European Patent Office Publication, Ser. No. 0014924 Kador, 2/8/80.

*Primary Examiner*—Trygve M. Blix
*Assistant Examiner*—Edwin L. Swinehart
*Attorney, Agent, or Firm*—Fleit, Jacobson, Cohn & Price

[57] ABSTRACT

In a sailboard rig, the boom is provided at its mast end with an extension using a torsion spring, which in an operative position extends in the plane of the boom and which is provided at its fore end with an eye for attaching a starting sheet.

6 Claims, 4 Drawing Figures

SAILBOARD RIG AND BOOM

This invention relates to a boom for sailboard rigs.

Before the start, the surfer must pull up the rig lying in the water. For this purpose, the mast end of the boom is provided with an eye or other means for attaching the starting sheet. To pull up the rig, the surfer standing on the sailboard takes hold of the eye or other fixing device. When the sail lies under the surface of the water and has a large projected area on the surface of the water, the rig can be pulled up only with difficulty and rather slowly because in that case the rig cannot be pulled up until the water dispsoed over the sail has run down from the latter. On the other hand, the rig can easily be pulled up when the boom extends at right angles or almost at right angles to the surface of the water.

It is an object of the invention to provide a device which is associated with a boom and with which the rig lying in the water can be pulled up more easily.

This object is accomplished according to the invention in that the boom is provided at its mast end with an extension, which is connected to the boom and extends in the plane of the boom and is provided at its forward end with an eye or other means for attaching the starting sheet. When tension is applied to the boom by means of the extension acting like a lever, the boom and the sail attached to the boom can be more easily turned around the mast to a position in which the boom is approximately at right angles to the surface of the water so that the rig can then easily and quickly be pulled out of the water.

Because the extension protruding from the mast would be disturbing during surfing, the extension is preferably connected to the boom by a hinge, which is provided with a stop that prevents a pivotal movement of the extension below the plane of the boom. The extension may be U-shaped and the free end of its legs may be hinged to the sides of the mast end of the boom.

The extension is suitably biased by spring means, which urge the extension to a non-disturbing, inactive position, in which the fore portion of the extension lies against the mast. Such spring means may comprise a torsion spring disposed adjacent to the hinge or hinges, or a rubber band, which connects the fore portion of the extension to the top end of the mast.

Figure 1:
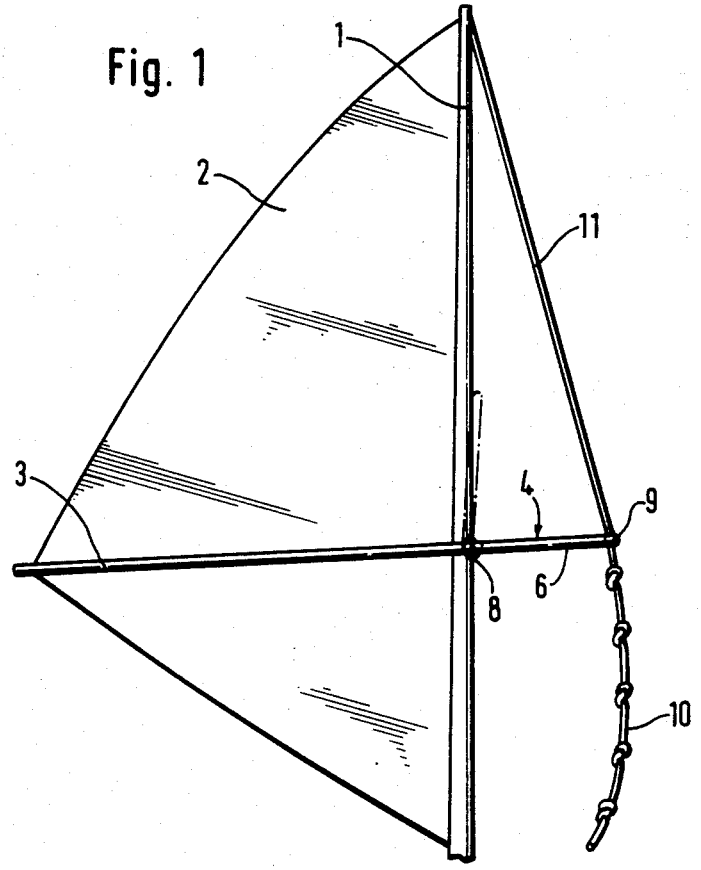
Figure 2:
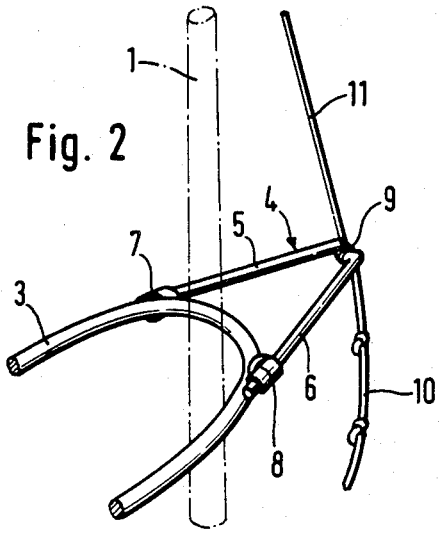
Figure 3:
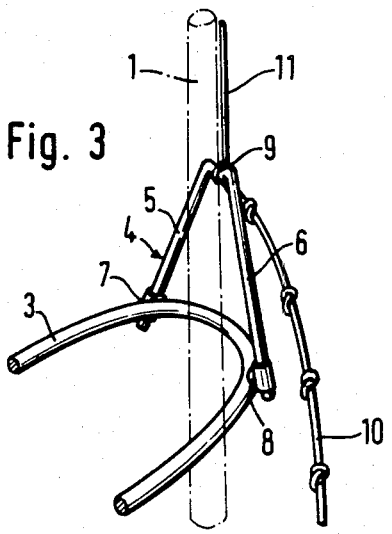

An illustrative embodiment of the invention will now be explained more in detail with reference to the accompanying drawings, in which FIG. 1 is a side elevation showing the rig, FIG. 2 is a perspective view showing the forward end of the boom with the extension using a rubber band which has been swung into the plane of the boom and FIG. 3 is a view that is similar to FIG. 2 but shows the extension swung against the mast.

Figure 4:
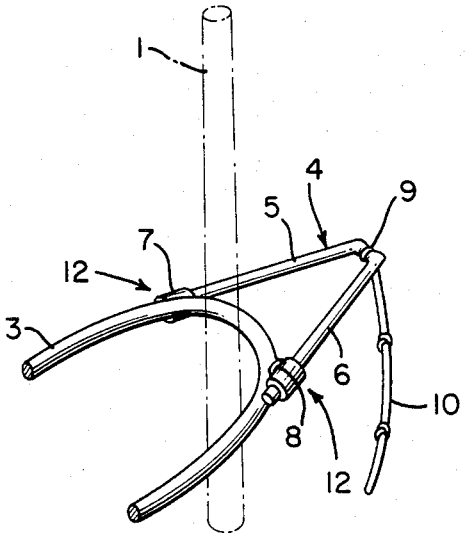

FIG. 4 is a perspective view showing the forward end of the boom with the extension using a torsion spring which has been swung into the plane of the boom by the starting sheet.

FIG. 1 shows a sail 2, which has been attached to the mast 1 and is usually extended by the boom 3, which extends on opposite sides of the mast.

At its mast end, the boom 3 is provided with a U-shaped extension 4, which has legs 5, 6, which are hinged to the sides of the fore end of the boom 3. The hinges 7, 8 are of conventional type and provided with a stop, which prevents a pivotal movement of the U-shaped extension 4 below the plane that is defined by the spars of the boom 3. The legs 5, 6 of the extension 4 are connected by a bight, which is provided with an eye 9, in which the starting sheet 10 is secured in known manner by a knot.

One end of a rubber band 11 is secured adjacent to the eye 9 and is secured at its other end to the top of the mast. When the starting sheet 10 is not being pulled, the rubber band 11 pulls up the extension 4 and holds the fore portion of the latter against the mast 1 in the position shown in FIG. 3. FIG. 4 shows the torsion springs 12 and the extension 4 being held in the plane of the boom by the starting sheet 10. When the starting sheet 10 is not being pulled, the torsion spring or springs 12 pulls up the extension 4 and holds the fore portion of the latter against the mast 1.

What is claimed is:

1. A sailboard rig comprising:

a mast;

a boom positioned substantially perpendicular to the mast;

a rigid extension member pivotably connected to the boom, said rigid extension being pivotable to an operative position wherein said rigid extension member extends in the plane of and a substantial distance from the boom;

stopping means for stopping the pivotable movement of the rigid extension member when in the operative position in the plane of the boom; and spring means for pivotably biasing the rigid extension member away from the plane of the boom to an inoperative position, whereby said rigid extension member can be moved from the inoperative position to the operative position in the plane of the boom to aid in turning a sail from a position parallel to the surface of the water to a position perpendicular to the surface of the water to facilitate removal of the sail from the water.

2. A sailboard rig as claimed in claim 1, wherein the rigid extension member is U-shaped with the free ends of its legs pivotably connected to the boom.

3. A sailboard rig as claimed in claim 1, wherein the spring means biases the rigid extension member to an inoperative position against the mast.

4. A sailboard rig as claimed in claim 1, wherein the spring means comprises a torsion spring.

5. A sailboard rig as claimed in claim 1, wherein said rigid extension member is pivotably connected at one end to the boom and a starting sheet is connected at the other end of the rigid extension member.

6. A sailboard rig as claimed in claim 1, wherein the spring means comprises a rubber band interconnecting the rigid extension member and the top of the mast.

* * * * *